United States Patent [19]

Obinata et al.

[11] 4,113,106

[45] Sep. 12, 1978

[54] PROCESS OF TIN FLOTATION

[75] Inventors: Shiro Obinata, Tokyo; Shigeru Hashimoto, Yokohama; Takeshi Sahara, Funabashi, all of Japan

[73] Assignee: Dowa Mining Co., Ltd., Tokyo, Japan

[21] Appl. No.: 613,928

[22] Filed: Sep. 16, 1975

[30] Foreign Application Priority Data

Jun. 4, 1975 [JP] Japan ..... 50-66374

[51] Int. Cl.[2] ..... B03D 1/02

[52] U.S. Cl. ..... 209/167; 75/2; 75/121

[58] Field of Search ..... 75/1, 2, 121, 101 R; 423/98; 209/166, 167

[56] References Cited

U.S. PATENT DOCUMENTS

| | | | |
|---|---|---|---|
| 2,383,427 | 8/1945 | Thompson et al. | 423/98 |
| 3,182,798 | 5/1965 | Duke | 209/166 |
| 3,286,837 | 11/1966 | Mercade et al. | 209/166 |
| 3,339,730 | 9/1967 | Boutin et al. | 209/166 |
| 3,902,602 | 9/1975 | Petrovich | 209/166 |

FOREIGN PATENT DOCUMENTS

| | | | |
|---|---|---|---|
| 122,177 | 9/1946 | Australia | 209/166 |
| 895,594 | 3/1972 | Canada | 209/166 |

*Primary Examiner*—L. Dewayne Rutledge
*Assistant Examiner*—Michael L. Lewis
*Attorney, Agent, or Firm*—Flynn & Frishauf

[57] ABSTRACT

An improved tin flotation process is disclosed.

Tin ores are subjected to flotation using sulfurous acid and/or sulfite in the flotation pulp to produce improved tin concentrates.

10 Claims, No Drawings

PROCESS OF TIN FLOTATION

This invention relates to improved flotation of tin ores, and is particularly concerned with producing high-grade tin concentrates in high recovery.

Up to this time, concentration of tin ores has been mostly effected by gravity concentration generally combined with other concentration means such as flotation, magnetic concentration, acid leaching and the like. This is because of the high specific gravity characteristics of cassiterite ($SnO_2$), which is known as a representative tin mineral. Namely, cassiterite occupies the major part of tin mineral species contained in the tin ores, and the specific gravity thereof ranges from 6.8 to 7.1, which is rather high as compared with those of gangue minerals such as quartz and the other silicate minerals. Thus, the gravity concentration has been conveniently applied to tin ores for the separation of cassiterite from gangue minerals.

However, one defect of gravity concentration is that the application thereof is limited by the particle size of the crushed ore. For example, gravity concentration has never been carried out with satisfactory results, when it is applied to finely powdered ores of minus 74 microns or less.

Accordingly, in case the association of the minerals and gangue requires a 74 micron or finer grind for liberation, gravity concentration has not been successful. As is known to those people skilled in this field of the art, flotation is the most advantageous means for the concentration of such finely ground ores. From this point of view, various trials were effected to obtain cassiterite as a flotation concentrate in the form of a froth by so-called "non-sulphide ore flotation." However, the problem of treating tin ores by flotation is not a simple problem due to the nature of the oxidized minerals contained in the ores. For example, if conventional flotation is applied to tin ores making use of conventional flotation reagents including collectors such as fatty acid, alkyl sulfate and alkyl sulfonate and conditioning agents such as sulfuric acid, hydrochloric acid and sodium silicate, the effective inhibition of oxidized iron minerals such as siderite and hematite is difficult, and substantial amount of the oxidized iron minerals go into a froth together with cassiterite. As a result, the tin grade of the tin concentrate thus obtained is at most 40% or so.

Modifications of the flotation by the combined application of subsidiary means such as magnetic separation, acid leaching, etc., have been proposed and tried to produce higher tin concentrates by removing the oxidized iron minerals. However, none of such trials has been fully successful. For example, magnetic separation has the defect that its capacity is limited and acid leaching never fails to provide a serious problem of how to treat the waste liquid before it is discarded. In addition, none of these combined application has been reported to provide satisfactory results in producing improved tin concentrates.

Accordingly, one object of this invention is to eliminate these defects of the prior art flotation of tin ores and to provide an effective process for the separation of the oxidized tin minerals (mainly cassiterite) from the oxidized iron mineral species, the separation of which from cassiterite has long been considered the most difficult.

These and other objects of the present invention have been accomplished according to the present invention by carrying out the flotation of tin ores making use of sulfurous acid and/or sulfite in the flotation pulp as a depressant for the oxidized iron minerals such as siderite, hematite, etc.

The invention is based on the unexpected discovery of the present inventors that oxidized iron minerals such as siderite and hematite, can be effectively inhibited by the presence of sulfurous acid and/or sulfite in the pulp for the flotation of tin ores. Namely, the gist of the present invention consists in the below-mention improvement in a flotation process comprising the steps of adding a conventional frother, collector and/or conditioning agent to a flotation pulp containing a tin ore and carrying out flotation to concentrate tin mineral species such as cassiterite in a froth, said improvement consisting in that the flotation is carried out in the presence of sulfurous acid and/or sulfite. That is, in the practice of the present invention, sulfurous acid, or sulfite or a mixture of both is used as an effective inhibitor, or depressant, for the oxidized iron minerals such as siderite and hematite. Illustrative of such sulfites are sodium sulfite, sodium hydrogensulfite and the like.

Frothers, collectors and conditioning agents generally employed in the conventional non-sulfide ore flotation can be conveniently used in the practice of the present invention. Thus, for example, useful frothers include pine oil, cresol, higher alcohols and the like; useful collectors include fatty acids such as oleic acid including soaps thereof such as sodium oleate as well as both ionic and cationic collectors such as sulfonate, cetyl sulfate and the like; and useful conditioning agents include hydrofluoric acid, sodium silicate, sodium sulfide, ammonia, silicate gel, soda ash, lime and the like.

Quantities of sulfurous acid and/or sulfite to be used in the practice of the present invention can vary widely depending on the various factors including properties of the ores, the oxide minerals content thereof, properties of the pulp and the like. Usually, quantities of sulfurous acid and/or sulfite used range from 5 to 2000 grams of $SO_2$ per ton of the ore to be treated, as converted into quantities of $SO_2$, instead of sulfurous acid and/or sulfite themselves, though preferable results are obtained when they are used in quantities ranging from 20 to 1000 grams of $SO_2$ on the same basis as mentioned above.

In a preferred embodiment of the present invention, tin ores are at first subjected to either conventional sulfide-mineral flotation or conventional non-sulfide-mineral flotation for the purpose of bringing the cassiterite grade to a certain level before the resulting flotation concentrate recovered as a froth is further subjected to the cleaning flotation for the purpose of removing oxidized iron minerals such as siderite and hematite from the first flotation products, the latter flotation being conveniently carried out according to the process of the present invention. That is, the process steps of the present invention can comprise (1) grinding tin ores to reduce into a suitable particle size such as minus 74 microns, said tin ores comprising cassiterite as a major tin mineral species and quartz and other silicates as gangue minerals as well as the other mineral species such as pyrite, pyrrhotite, sphalerite, chalcopyrite, hematite, siderite, fluorite and the like; (2) subjecting the ground ores to conventional sulfide-ore flotation for removing sulfide minerals such as pyrite, pyrrhotite, sphalerite, chalcopyrite and the like as much as possible by concentrating them in a froth; (3) subjecting the flotation tailing from the previous step to classification for the purpose of removing fine slimes such as the minus several micron slimes which may interfere in the succeeding flotation steps; (4) subjecting the classifier products free from slimes to a conventional tin flotation making use of conventional flotation reagents such as pine oil as a frother, sulfonate such as sodium sulfonate as a collector and a conditioning agent such as hydrofluoric acid, sodium silicate or sodium silicofluoride, etc., wherein gangue minerals such as quartz and other silicates or the other mineral species such as fluorite, etc. are inhibited intentionally to concentrate cassiterite in a froth; and (5) subjecting the cassiterite concentrates thus obtained to further flotation which is carried out in the presence of sulfurous acid and/or sulfite and in the presence or absence of the conventional flotation reagents selected from conventional frothers, collectors and conditioning agents as described hereinbefore.

Thus, according to the improved tin flotation of the present invention, it has become possible to produce high grades of tin concentrates in high yield from low grades of ores. In addition, the necessity of the combined use of the other separating means such as gravity concentration, magnetic separation, acid leaching and the like has been eliminated. As a result, the flowsheet has been simplified, which contributes to the reduction of the initial cost of equipments.

The invention will be further illustrated by the following working example.

EXAMPLE

A tin ore produced in Bolivia comprising cassiterite, pyrite, pyrrhotite, sphalerite, siderite, fluorite, quartz and other silicate minerals was used as the initial feed for flotation. The assay of this ore is: 0.54% Sn; 2.44% Zn; 10.17% Fe; 6.40% S; 51.88% $SiO_2$; 0.60% Ca. This ore was ground by wet grinding to a grain size about 90% of which was minus 200 mesh, and then, to the ground ore adjusting amount of water was added to produce a pulp comprising approximately 30% solids. To this pulp, 300 grams of Aeropromotor 412 (Trademark of a collector available from A.C.C., that is, American Cyanamid Company) and 100 grams of pine oil as a frother, per ton of the initial feed, respectively, were added.

This pulp was subjected to a sulfide-mineral flotation to remove sulfide minerals by concentrating in a froth. To the pulp after removing the froth, 700 grams of quebrachotannin per ton of the initial feed was added to disperse the pulp, and fine slimes were removed by decantation. The remaining sand was subjected to a conventional tin flotation (rougher flotation), using sodium fluorosilicate in an amount of 500 grams per ton of the initial feed, hydrofluoric acid in an amount of 800 grams per ton of the initial feed and Aeropromoter 830 (Trademark, available from A.C.C.) as a collector in an amount of 300 grams per ton of the initial feed, to produce a rougher flotation concentrate which was cleaned three times by a three-stage successive flotation section to produce primary, secondary and tertiary cleaning concentrate, respectively. The results of the above experiment are summarized in Table I below.

Table I

| | Weight | Assay % | | | Distribution % | | |
|---|---|---|---|---|---|---|---|
| | % | Sn | Fe | S | Sn | Fe | S |
| Initial Feed | 100.0 | 0.54 | 10.17 | 6.40 | 100.0 | 100.0 | 100.0 |
| Sulfide Flotation Froth | 30.4 | 0.28 | 24.08 | 20.09 | 15.5 | 72.0 | 95.4 |
| Slime | 22.7 | 0.24 | 4.49 | 0.64 | 10.0 | 10.0 | 2.3 |
| Rougher Flotation Tailing | 42.7 | 0.13 | 3.07 | 0.17 | 10.2 | 12.9 | 1.1 |
| Cleaning Flotation Tailings in total | 3.2 | 0.72 | 11.56 | 1.00 | 4.3 | 3.6 | 0.5 |
| Tertiary Cleaning Flotation Concentrate | 1.0 | 33.75 | 15.52 | 4.58 | 60.0 | 1.5 | 0.7 |

The tertiary cleaning flotation concentrate was then divided equally into three lots. These three lots were subjected to the three kinds of different treatments as shown below; the first lot to a flotation of the present invention; the second lot to a conventional tin flotation; and the third lot to a magnetic separation.

Treatment 1

The tin concentrate of the first lot was suspended in water to make a suspension comprising approximately 30% solids and was subjected to flotation by adding to the pulp sulfurous acid in a quantity of 30 grams of $SO_2$ per ton of the initial feed, said quantity being converted into that of $SO_2$ instead of sulfurous acid itself. The results of this treatment are shown in Table II below.

Treatment 2

The tin concentrate of the second lot was subjected to a further cleaning flotation without using sulfurous acid in the pulp but using the same reagents as in the previous cleaning flotation stages, namely, using 5 grams of sodium silicate per ton of the initial feed, 8 grams of sodium fluorosilicate per ton of the initial feed and 3 grams of hydrofluoric acid per ton of the initial feed. The results of this treatment are also shown in Table II below.

Treatment 3

The tin concentrate of the third lot was subjected to magnetic separation using a high flux magnetic separator at a magnetic flux density of 10,000 Gaus to produce a higher grade of tin concentrate. The results of this treatment also are shown in Table II below.

Table II

| | Weight | Assay % | | | Distribution % | | |
|---|---|---|---|---|---|---|---|
| | % | Sn | Fe | S | Sn | Fe | S |
| | | | | | (60.0) | | |

Table II-continued

| | | Weight | Assay % | | | Distribution % | | |
|---|---|---|---|---|---|---|---|---|
| | | % | Sn | Fe | S | Sn | Fe | S |
| Treatment 1 | Feed | 100.0 | 33.75 | 15.52 | 4.58 | 100.0 (58.0) | 100.0 | 100.0 |
| (Present | Concentrate | 55.4 | 58.90 | 4.84 | 1.09 | 96.6 (2.0) | 17.3 | 13.2 |
| Invention) | Tailing | 44.6 | 2.58 | 28.78 | 8.91 | 3.4 (60.0) | 82.7 | 86.8 |
| Treatment 2 | Feed | 100.0 | 35.07 | 17.29 | 3.64 | 100.0 (58.0) | 100.0 | 100.0 |
| (Prior Art) | Concentrate | 87.0 | 39.00 | 16.88 | 3.63 | 96.7 (2.0) | 84.9 | 86.8 |
| | Tailing | 13.0 | 8.80 | 20.04 | 3.70 | 3.3 (60.0) | 15.1 | 13.2 |
| Treatment 3 | Feed | 100.0 | 34.12 | 15.82 | 3.75 | 100.0 (55.9) | 100.0 | 100.0 |
| (Prior Art) | Concentrate | 62.5 | 50.87 | 6.74 | 3.08 | 93.2 (4.1) | 26.6 | 51.3 |
| | Tailing | 37.5 | 6.21 | 30.95 | 4.87 | 6.8 | 73.4 | 48.7 |

Note: Numerical values given in parentheses show the distribution based on the initial feed (See Table I).

Table II shows that the tin grade of the concentrate produced in the first treatment, which was carried out in the presence of sulfurous acid according to the present invention, is as high as 58.90%. This grade is about 20% higher than that of the tin concentrate produced in the second treatment, which was carried out in the absence of sulfurous acid according to the prior art tin flotation. The tin grade of the concentrate obtained in the first treatment is about 8% higher as compared with that of the tin concentrate produced in the third treatment, which was carried out by magnetic separation.

Table II also shows that the process of the present invention provides no substantial decrease in the recovery percentage of tin as compared with the results obtained by the prior art processes. That is, the recovery percentages based on the initial feed are given in Table II as 58.0%, 58.0% and 55.9% for the first, the second and the third treatment, respectively. This result shows that the recovery percentage of tin in the first treatment is superior to that in the third treatment in which magnetic separation was employed. It also shows that the ratio of concentration has been remarkably improved by the use of the present invention.

The experimental results also show that cassiterite which has once been rendered hydrophobic in the previous cleaning flotation section has been activated enough to float again in the succeeding flotation section without being inhibited even in the presence of sulfurous acid as an inhibitor, even if no collector is newly added to the pulp. In this final flotation section, oxidized iron minerals such as siderite, hematite, etc. are effectively inhibited due to the presence of sulfurous acid, while cassiterite is floated in the form of a froth in good efficiency.

The experimental results also show that sulphide minerals which have not been removed in the previous sulfide-mineral flotation section and remain in the cleaning flotation concentrate can be effectively inhibited in the final flotation section due to the presence of sulfurous acid and can be effectively removed from the final tin concentrate, which seems to contribute to a remarkable improvement in the quality of the final tin concentrate obtained according to the present invention as compared with those obtained according to the prior art processes wherein no sulfurous acid is used in the flotation or magnetic separation is employed in combination with the flotation.

When similar experiments were repeated only replacing sodium sulfite and sodium hydrogensulfite for said sulfurous acid respectively, similar better results were obtained. Thus, it has been confirmed that the presence of sulfite ion apparently contributes to the advantage of the present invention.

What we claim is:

1. A process for the flotation of tin from a tin concentrate containing cassiterite and siderite to float cassiterite as a froth, wherein said tin concentrate is formed by removing in a froth sulfide minerals contained in a tin ore, removing fine slimes from the resulting flotation tailing and subjecting the substantially fine slime-free product to conventional tin flotation, characterized by subjecting said tin concentrate containing cassiterite and siderite to flotation with a frother consisting essentially of pine oil or cresol in the presence of an inhibitor for siderite consisting essentially of at least one of sulfurous acid and a sulfite.

2. The tin flotation process as defined in claim 1, wherein at least one of sulfurous acid and a sulfite is used in said flotation in in a quantity corresponding to from 5 to 2000 grams of $SO_2$ per ton of initial tin ore.

3. The tin flotation process as defined in claim 1, wherein at least one of sulfurous acid and a sulfite is used in said flotation in a quantity corresponding to from 20 to 1000 grams of $SO_2$ per ton of initial tin ore.

4. The tin flotation process as defined in claim 1, wherein sulfurous acid is used in said flotation.

5. The tin flotation process as defined in claim 1, wherein sulfurous acid is used in said flotation in a quantity corresponding to from 5 to 2000 grams of $SO_2$ per ton of initial mineral feed.

6. The tin flotation process as defined in claim 1, wherein sulfurous acid is used in said flotation in a quantity corresponding to from 20 to 1000 grams of $SO_2$ per ton of initial mineral feed.

7. The process of claim 1, wherein the frother is pine oil.

8. In a process of tin flotation from a tin concentrate containing cassiterite and siderite to float cassiterite as a froth, the improvement which comprises subjecting said tin concentrate containing cassiterite and siderite to flotation with a frother consisting essentially of pine oil or cresol in the presence of an inhibitor for siderite consisting essentially of at least one of sulfurous acid and a sulfite.

9. The process of claim 8, wherein the oxidized iron mineral is at least one of siderite and hematite.

10. The process of claim 8, wherein the frother is pine oil.

* * * * *